US011285350B2

(12) United States Patent
Edeker

(10) Patent No.: US 11,285,350 B2
(45) Date of Patent: Mar. 29, 2022

(54) ADJUSTABLE INDIAN CLUB/LONG HANDLE MACE DEVICE AND METHOD

(71) Applicant: Kurt William Edeker, Austin, TX (US)

(72) Inventor: Kurt William Edeker, Austin, TX (US)

(73) Assignee: Kurt William Edeker, Austin, TX (US)

( * ) Notice: Subject to any disclaimer, the term of this patent is extended or adjusted under 35 U.S.C. 154(b) by 3 days.

(21) Appl. No.: 16/350,303

(22) Filed: Oct. 30, 2018

(65) Prior Publication Data

US 2020/0129800 A1 Apr. 30, 2020

(51) Int. Cl.

*A63B 15/00* (2006.01)
*A63B 21/06* (2006.01)
*A63B 21/00* (2006.01)

(52) U.S. Cl.

CPC ..... *A63B 15/00* (2013.01); *A63B 21/0602* (2013.01); *A63B 21/0603* (2013.01); *A63B 21/4035* (2015.10); *A63B 2225/09* (2013.01)

(58) Field of Classification Search

CPC ..... A63B 15/00; A63B 7/086; A63B 21/0608; A63B 21/075; A63B 21/0004

See application file for complete search history.

(56) References Cited

U.S. PATENT DOCUMENTS 4,696,468 A * 9/1987 Dube ..... A63B 15/00 473/118
4,743,016 A * 5/1988 Van Derworp ..... A63B 21/075 482/93
5,580,321 A * 12/1996 Rennhack ..... A63B 15/00 473/234
6,682,447 B1 * 1/2004 Black ..... A63B 15/00 473/457
8,771,108 B2 * 7/2014 Auzoux ..... A63B 60/48 473/463
9,526,671 B2 * 12/2016 Week ..... A61H 23/006
10,166,428 B2 * 1/2019 Giafardino ..... A63B 15/00
2002/0072427 A1 * 6/2002 Chang ..... A63B 15/00 473/219

(Continued)

FOREIGN PATENT DOCUMENTS

FR 2799658 A1 * 4/2001
GB 190901609 A * 3/1909
JP 3178749 U * 9/2012

*Primary Examiner* — Joshua T Kennedy

(57) ABSTRACT

A handheld device of a uniquely adjustable nature for the purpose of exercise of the human body. The handheld device can be moved freely in any direction or pattern at any speed or pace generated and desired by the user creating a wide variety of resistance, leverage, torque and/or momentum. The device will comprise an elongated hollow body of two ends, one end being open and of a length and circumference to provide a secure gripping surface, the other end being closed and of a larger size and bulbous shape to contain a quantity of any suitable material in order to adjust the weight. A given material will be contained within the device with a cap or lid. The device will also have an optional extension handle, which will provide an even greater variety of exercise using resistance, leverage, torque and/or momentum.

1 Claim, 10 Drawing Sheets

(56) References Cited

U.S. PATENT DOCUMENTS

| | | | | |
|---|---|---|---|---|
| 2003/0069095 | A1* | 4/2003 | Turos | A63B 69/0002 473/457 |
| 2017/0072249 | A1* | 3/2017 | Duffin | A63B 21/0608 |
| 2018/0056159 | A1* | 3/2018 | Franco | A63B 21/00061 |
| 2018/0264316 | A1* | 9/2018 | Liu | A63B 23/14 |

* cited by examiner

ADJUSTABLE INDIAN CLUB/LONG HANDLE MACE DEVICE AND METHOD

This U.S. non-provisional patent application is related to U.S. Provisional Application No. 62/707,271 filed Oct. 27, 2017 and claims the benefit of that filing date.

FIELD OF INVENTION

The current invention is an improved exercise device and method, more specifically an exercise device providing a unique adjustable/fillable exercise device providing a wide range of resistance, torque and/or momentum. By adjusting the weight, body position movement direction and speed it is possible to exercise all major muscle groups of the body. By attaching the unique extension handle it is possible to generate an even wider variety of resistance, leverage, torque and/or momentum.

DETAILED DESCRIPTION OF INVENTION

Figure 1:
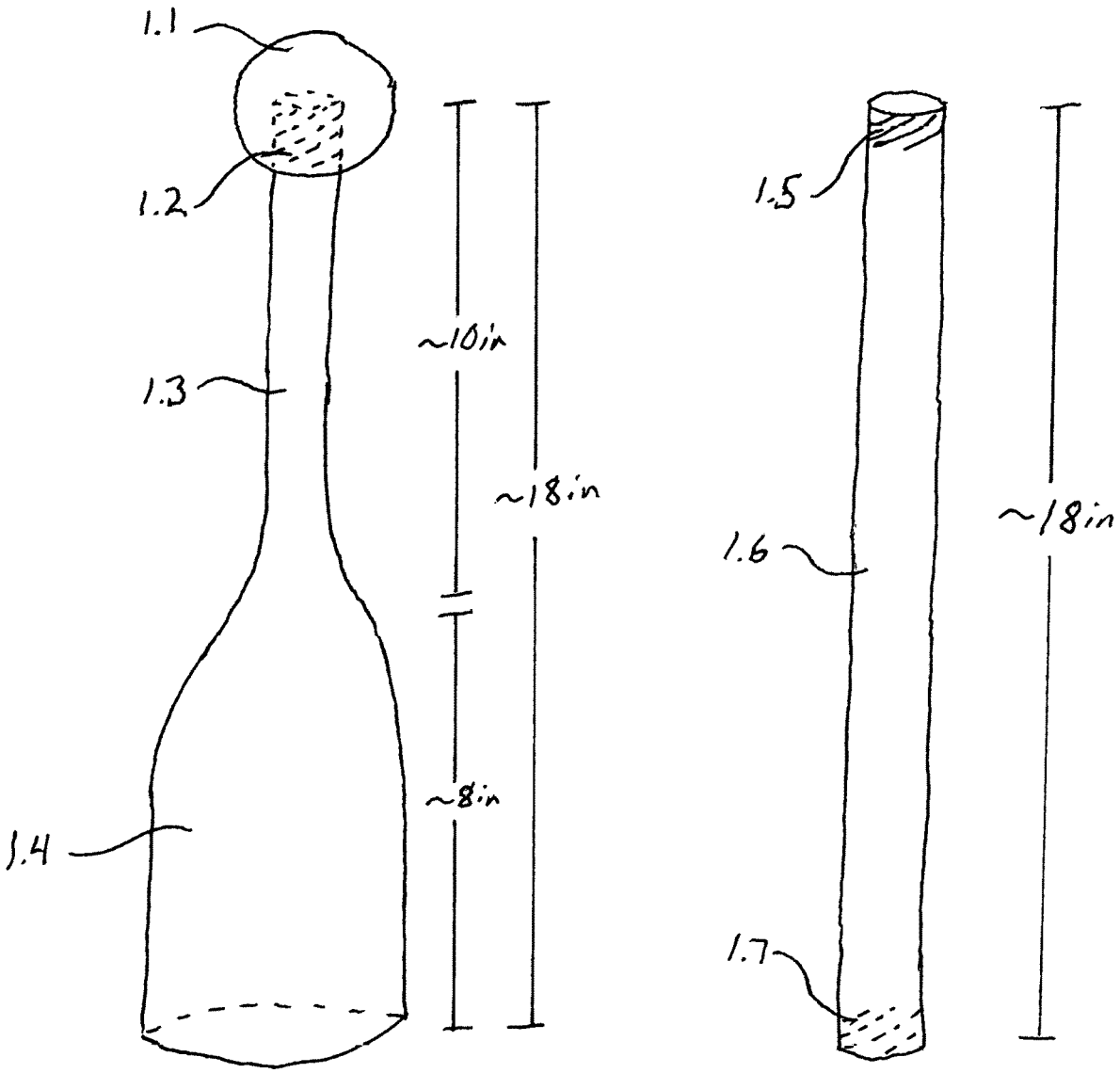
FIG. 1 is a representation of an embodiment of the device showing an elongated hollow body, open at one end (1.2), the closed end (1.4) being of a size and shape to contain a quantity of a given material, the open end of a suitable length and circumference to provide a secure gripping surface (1.3) for at least a single hand, a watertight cap or lid (1.1) to contain a given material and an extension handle (1.6) open at both ends, one end being able to mate with the open end of the device (1.7) and the other end being able to mate with a watertight cap or lid (1.5) and of a suitable length and circumference to provide a secure gripping surface for two hands. All measurements are approximate and may be varied within reason.
Figure 2:
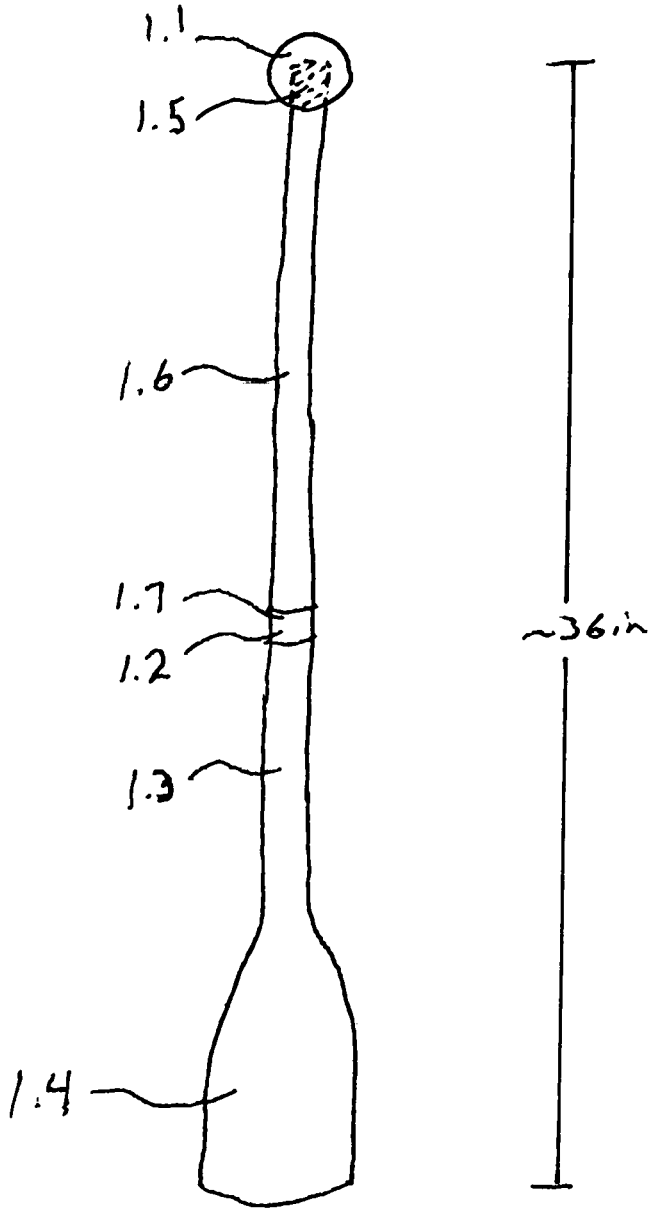
FIG. 2 is a representation of an embodiment of the assembled device comprising the club body (1.4 continuous with 1.3), the Mace Extension Handle (1.6) and the watertight cap or lid (1.1). All measurements are approximate and may be varied within reason.
Figure 3A:
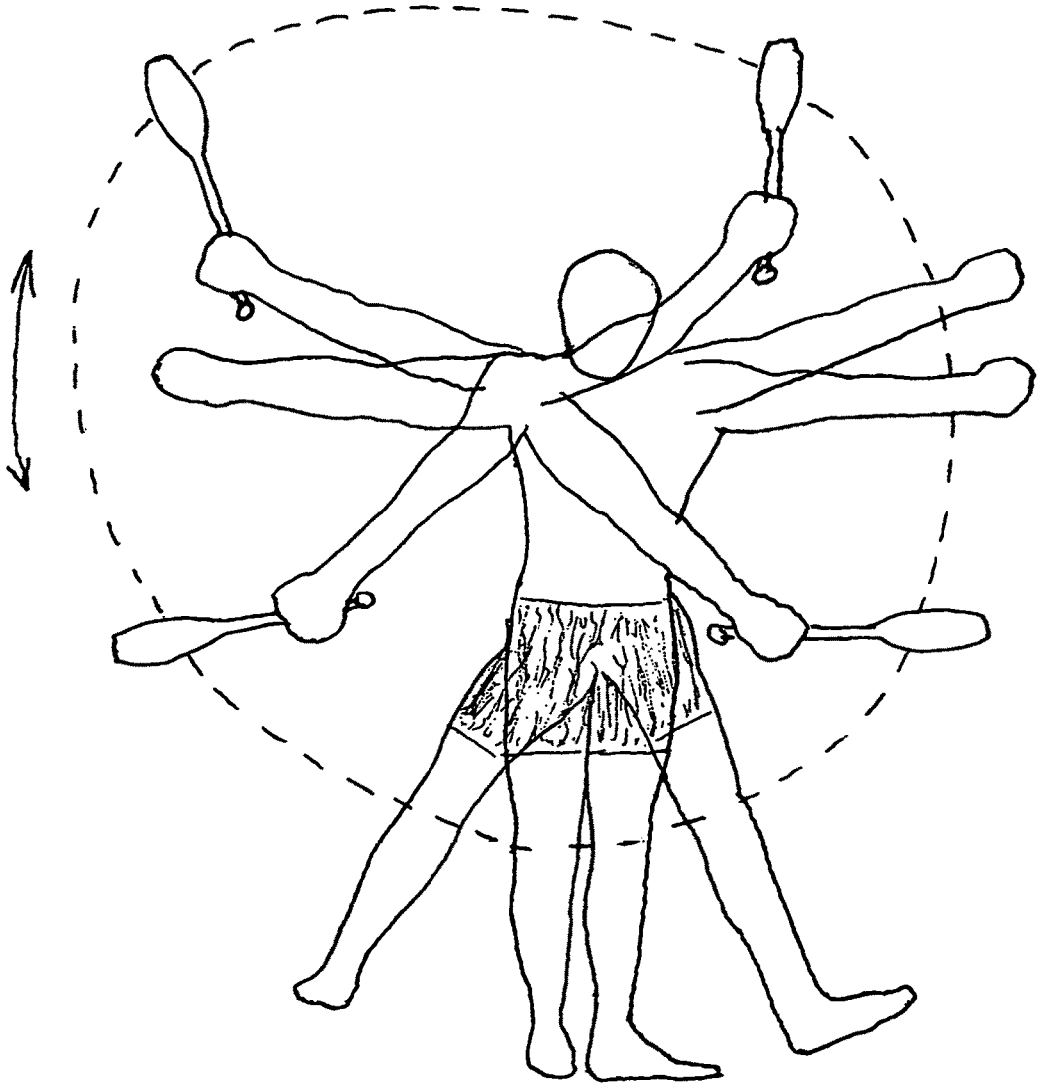
FIG. 3*a*-FIG. 3*f* are a representation of only some of the many movements that may be used for exercising the body with the device. A generic Vitruvian Man has been used to help demonstrate the wide variety of hand, elbow, shoulder, body and leg positions possible. By moving the device at various speeds, fast or slow, the user may achieve a wide variety of resistance, leverage, torque and/or momentum.
Figure 3B:
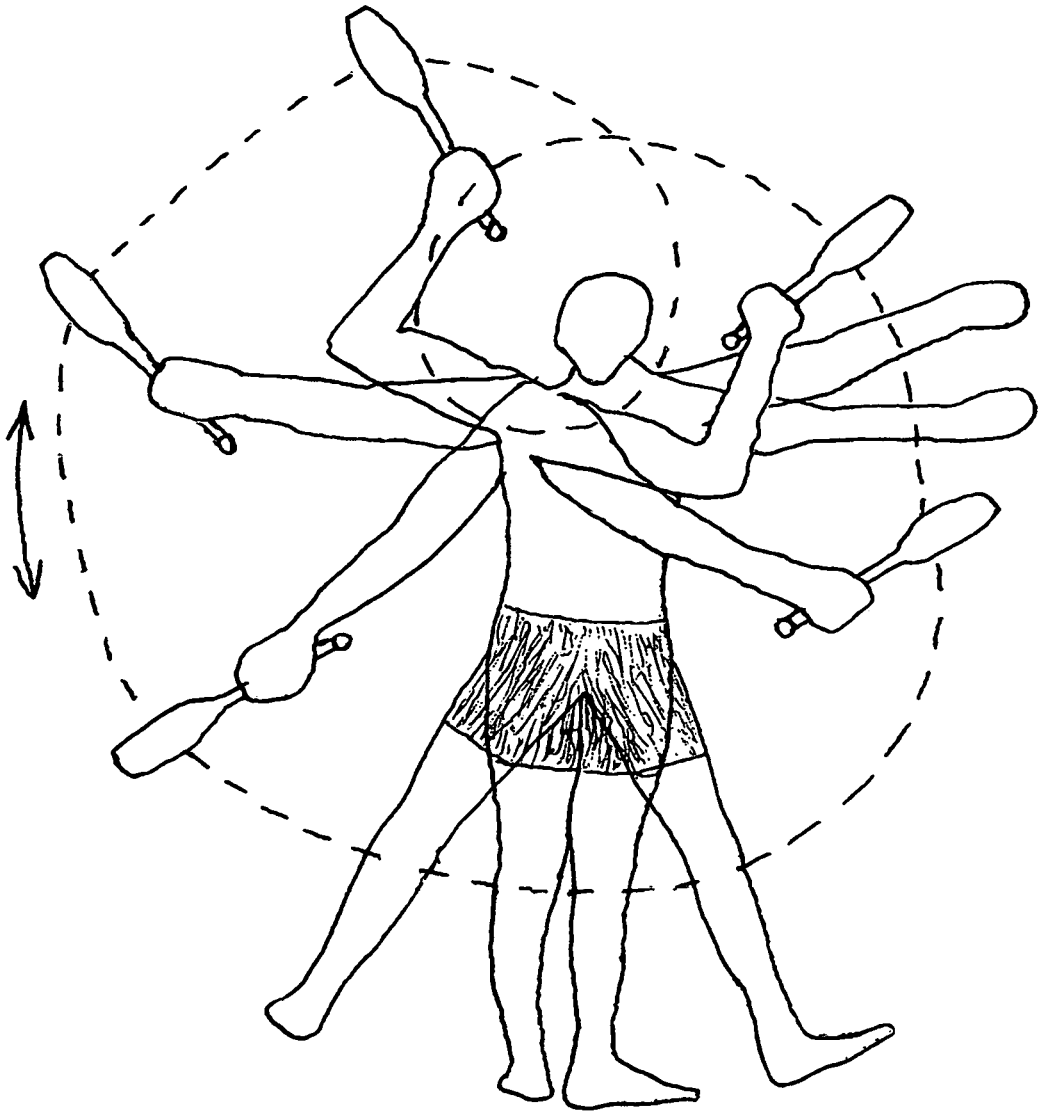
Figure 3C:
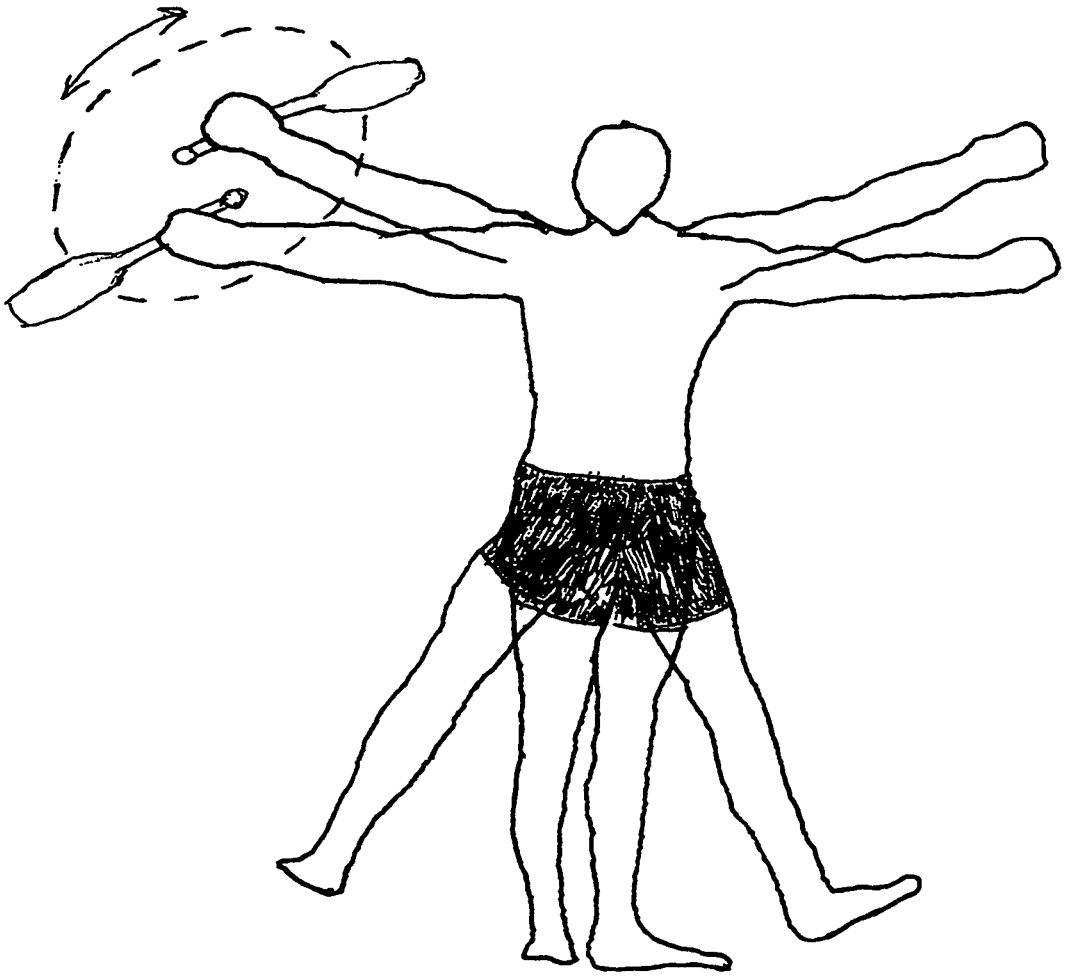
Figure 3D:
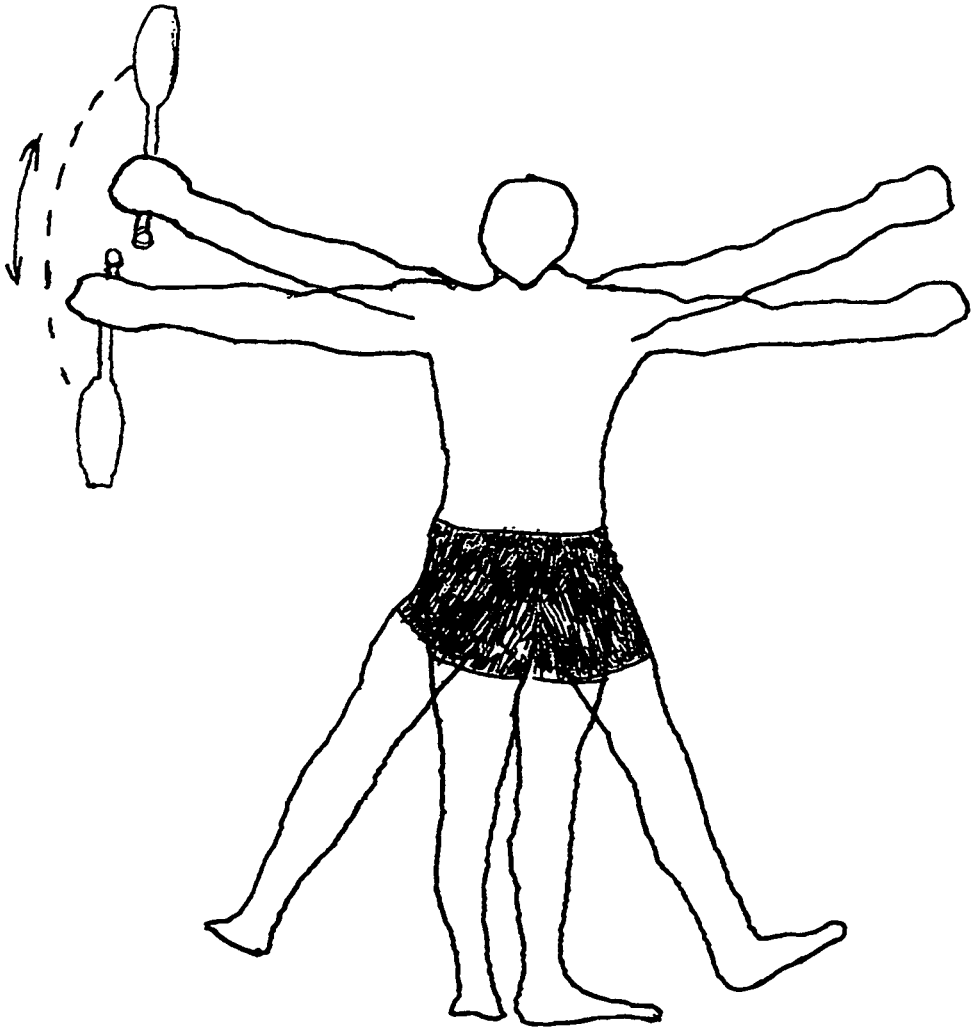
Figure 3E:
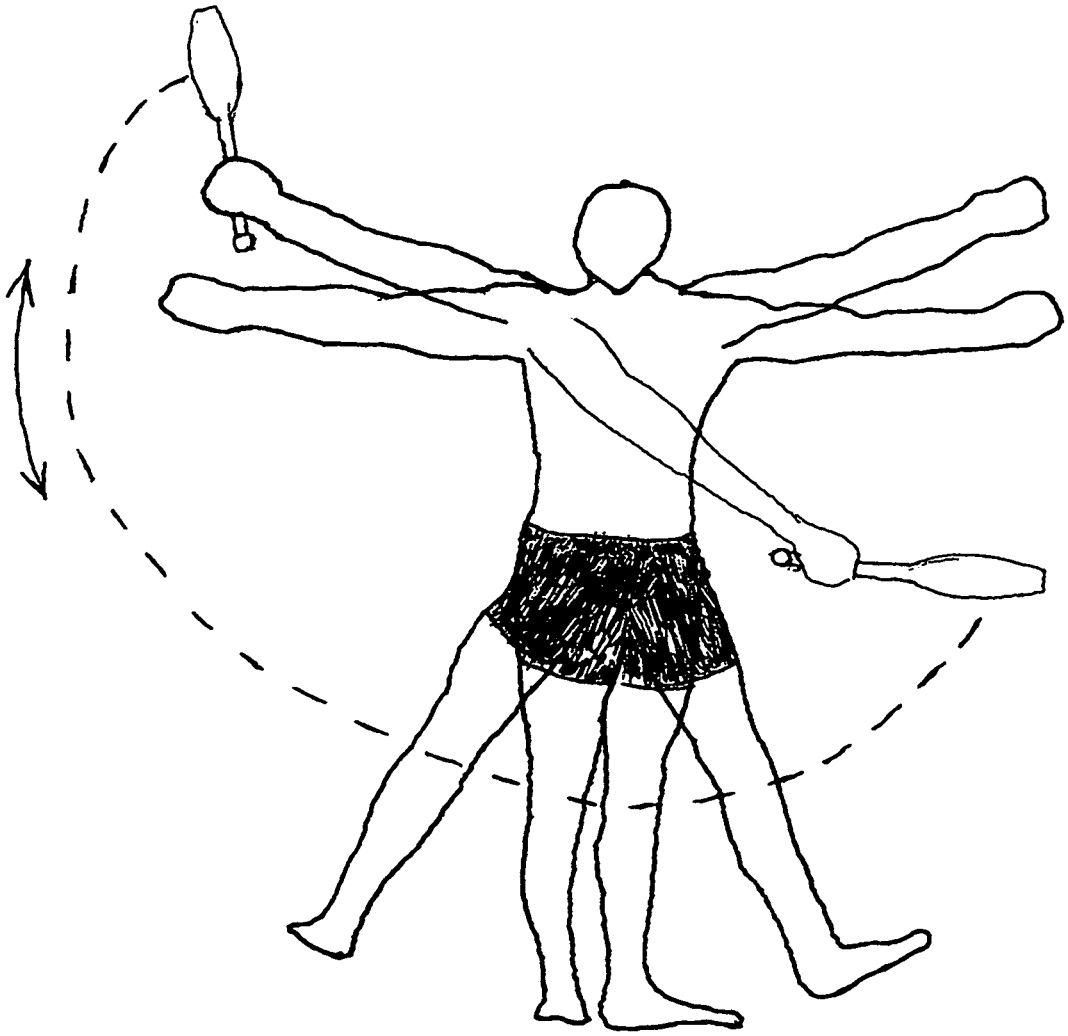
Figure 3F:
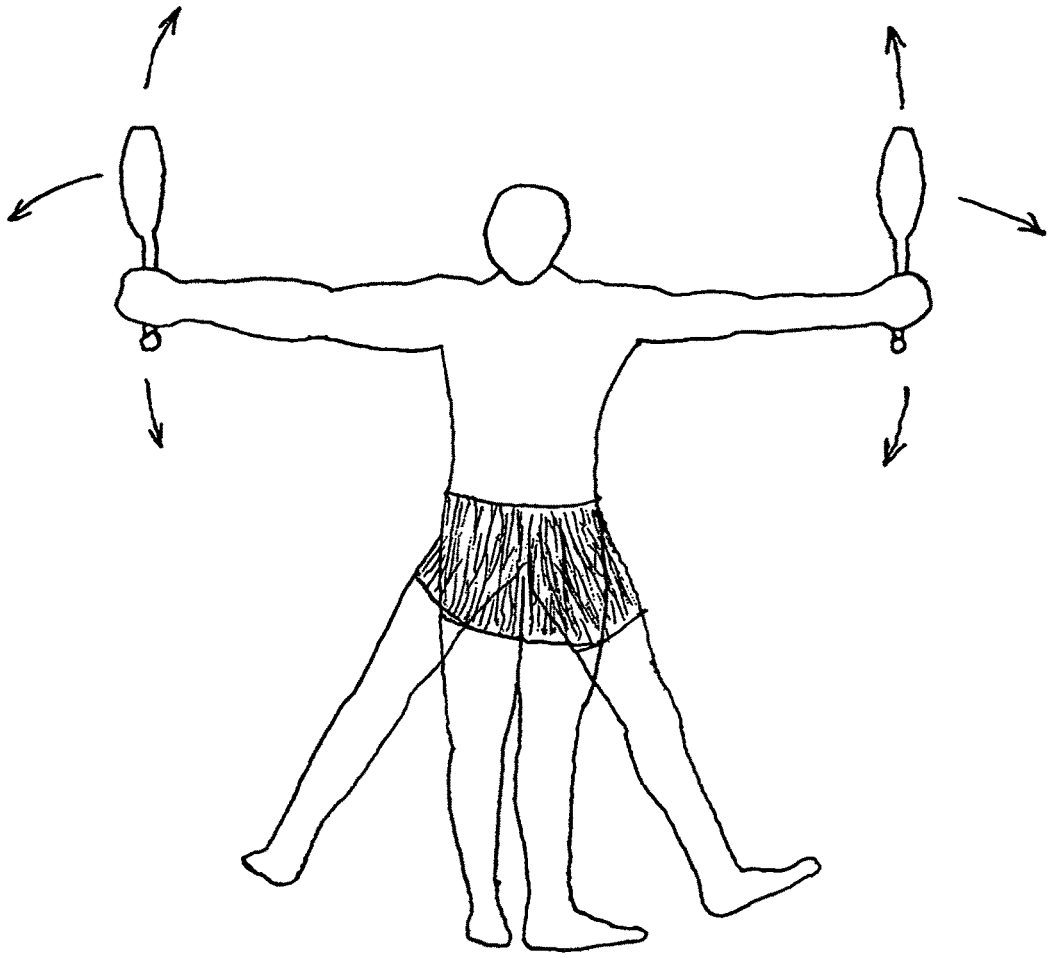
Figure 4:
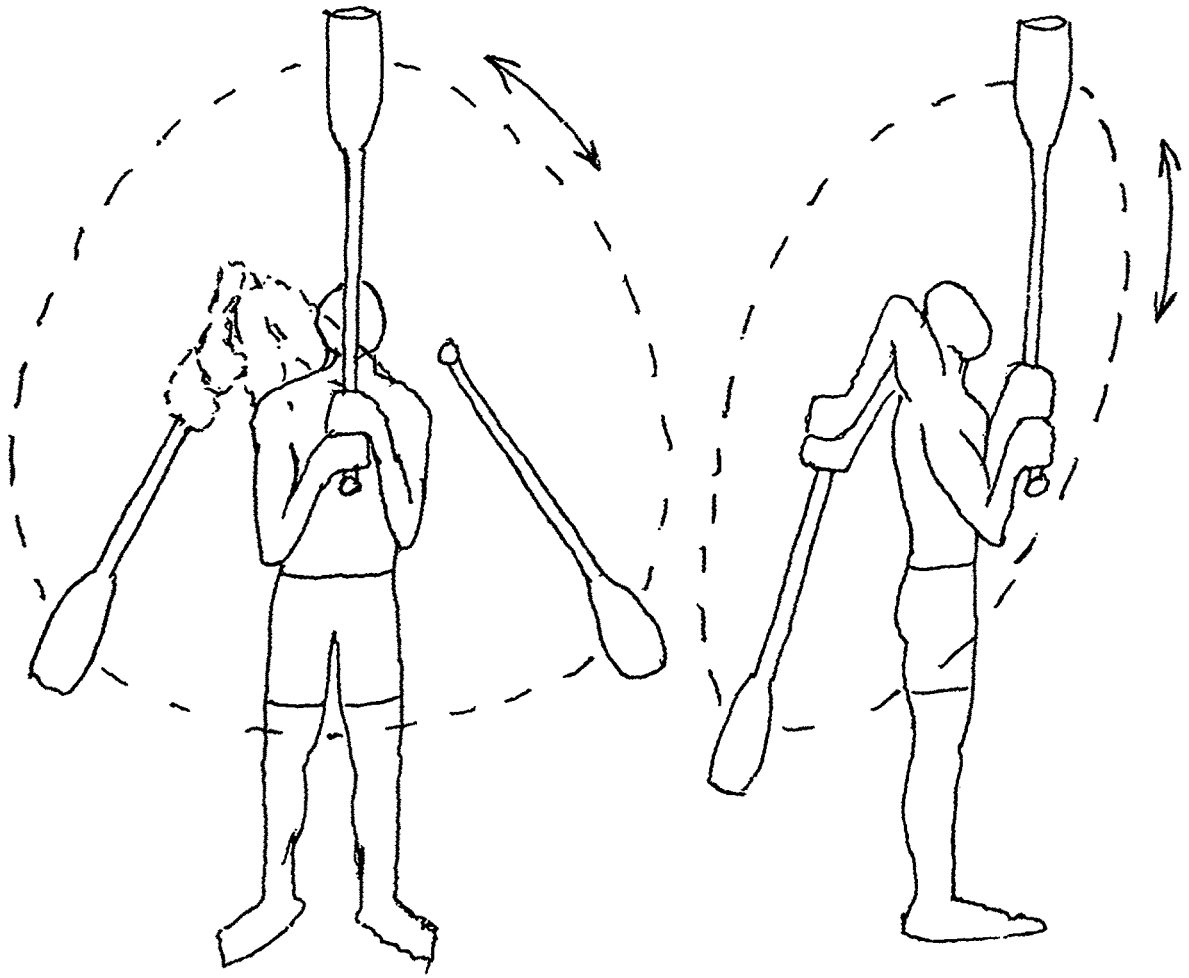
FIG. 4 is a representation of a method of using the device assembled as a Long Handle Mace wherein; the user grasps the extension portion of the device with both hands; stabilizes the device as shown in front of the body; using grip, elbow, shoulder and body positions moves the device in a clockwise or counterclockwise manner guiding the device behind the head and body in an elliptical pattern, returning the device to its starting position creating resistance, leverage, torque and/or momentum.
Figure 5:
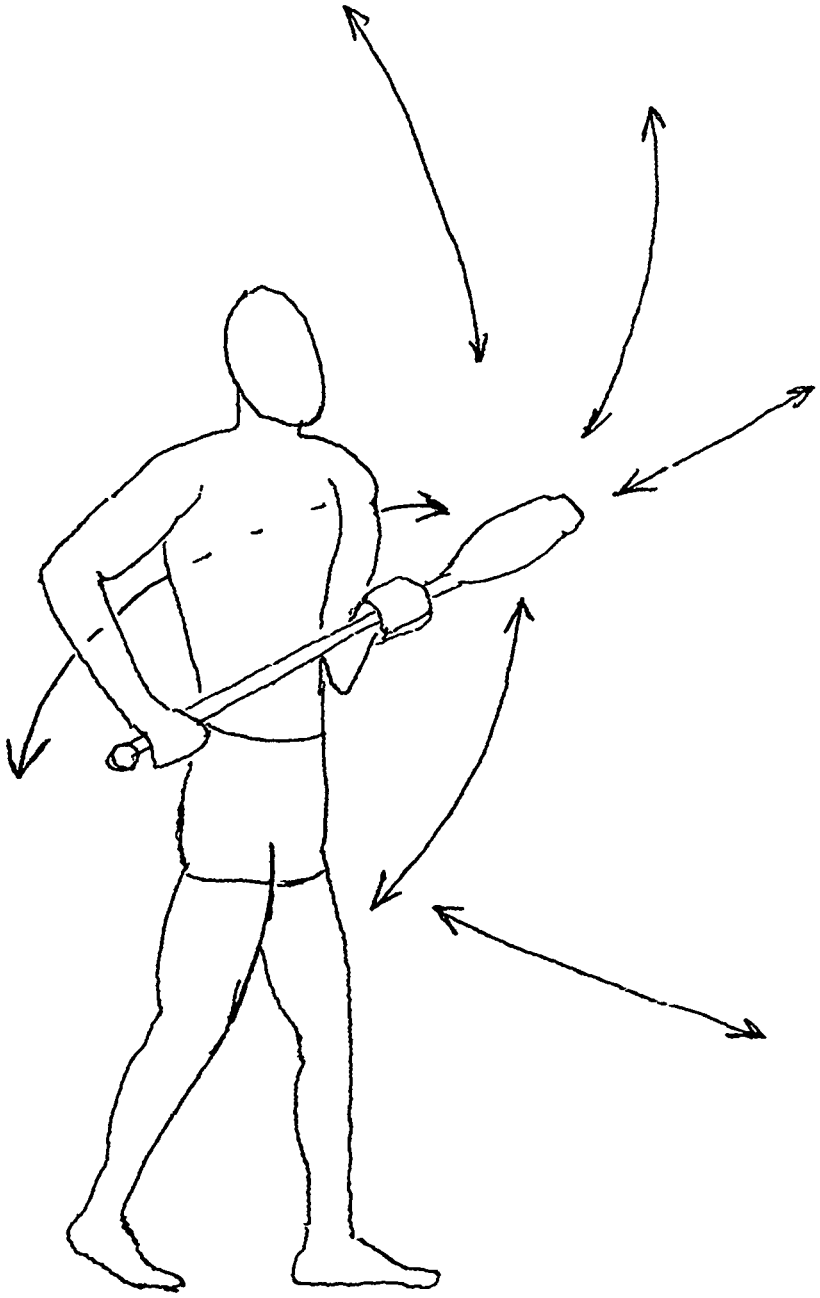
FIG. 5 is a representation of a method of using the device assembled as a Long Handle Mace wherein the user grasps the handle such that one hand is placed at the end of the handle, the other hand is placed at a distance closer to the body of the assembled device, the user will then move the device in any direction or speed desired, thus generating a wide variety of resistance, leverage, torque and/or momentum.

One aspect of the current invention is the continuous hollow body (1.4) of the Indian Club open at the handle end (1.2) being able to be filled or emptied of any appropriate given material to easily adjust the weight of the device. The device may be manufactured in any manner that allows a hollow form including but not limited to plastic blow molding or cast and assembled. The device may be made of any material that allows the formation of a hollow structure in the manner and shape described.

The unique handle end opening (1.2) is a safe and secure method of filling, emptying and containing a given material. The given material that may be added or removed includes material such as, but not limited to: water, rice, beans, sand and steel shot. The material is the secured within the device with a watertight cap or lid, thus altering the weight of the device in any assembled configuration enabling an even greater variety and ability to generate resistance, leverage, torque, and/or momentum. Movements and patterns are not limited to those shown and may be created and ad-libbed by the user.

The shape and weighting of the device, in combination with the users movement, position and speed of movement, can provide a very wide range of resistance, leverage, torque and/or momentum.

The addition of the unique Mace Extension Handle (1.6) provides additional internal volume for a given material and greatly added potential for increased and different resistance, leverage, torque and/or momentum.

The invention claimed is:

1. A hand held exercise device comprising:

a one piece, unitary hollow elongated body, comprising:

a head portion having a bulbous shape asymmetrical along its length and being closed at a first end;

wherein the head portion is configured to contain a quantity of a loose material while still allowing the user reasonable and desired movement of said material therein;

an elongated handle portion of constant diameter extending from and having a smaller diameter than said head portion; said elongated handle portion having an open second end with a fastening portion adjacent to said second end, wherein said handle portion is configured to provide a secure gripping surface for at least a single hand of a user;

an elongated extension handle open at both ends and of a hollow nature along its entire length and of a similar diameter along its entire length of said elongated handle portion; the extension handle having a first fastening portion at a first end configured to mate with said fastening portion of said elongated handle portion and a second fastening portion at a second end; said extension handle to be of a length to provide a secure and suitable gripping surface for at least two hands of a user; and a generally spherical securing cap configured to be fitted to either the fastening portion of said second end of elongated handle portion or said second fastening portion of said extension handle and configured to confine said material within the device during use while allowing a user to easily fill, empty, or exchange a variety of materials to easily adjust the weight of the device at a users' discretion; said spherical shape of said cap being configured to provide additional grip security to resist centrifugal forces generated during use.

* * * * *